US008920289B2

(12) United States Patent
Query, Jr. et al.

(10) Patent No.: US 8,920,289 B2
(45) Date of Patent: Dec. 30, 2014

(54) FORM ASSEMBLY FOR A JUMP PIT

(75) Inventors: William Kress Query, Jr., Matthews, NC (US); Christopher Charles Cucchiara, Statesville, NC (US)

(73) Assignee: ABT, Inc., Troutman, NC (US)

( * ) Notice: Subject to any disclaimer, the term of this patent is extended or adjusted under 35 U.S.C. 154(b) by 209 days.

(21) Appl. No.: 13/350,613

(22) Filed: Jan. 13, 2012

(65) Prior Publication Data

US 2012/0184411 A1 Jul. 19, 2012

Related U.S. Application Data

(60) Provisional application No. 61/432,575, filed on Jan. 13, 2011.

(51) Int. Cl.
*A63B 71/02* (2006.01)
*A63B 5/00* (2006.01)

(52) U.S. Cl.
CPC ..... *A63B 5/00* (2013.01)
USPC ..... 482/15; 52/741.1

(58) Field of Classification Search
USPC ..... 482/15, 148; 52/309.12, 21, 741.1
See application file for complete search history.

(56) References Cited

U.S. PATENT DOCUMENTS

| | | | | |
|---|---|---|---|---|
| 2,588,722 | A * | 3/1952 | Hendershott | 482/15 |
| 3,369,808 | A * | 2/1968 | Sconce | 482/15 |
| 4,223,501 | A * | 9/1980 | DeLozier | 52/309.12 |
| 4,882,882 | A * | 11/1989 | Werner | 52/21 |
| 7,641,593 | B2 | 1/2010 | Goulet | |
| 8,186,125 | B2 * | 5/2012 | Goulet | 52/741.1 |
| 8,337,318 | B2 * | 12/2012 | Oliver | 472/92 |
| 8,555,584 | B2 * | 10/2013 | Ciuperca | 52/309.7 |
| 2004/0053747 | A1 * | 3/2004 | Bollinger | 482/15 |
| 2008/0064570 | A1 * | 3/2008 | Rastegar | 482/15 |
| 2008/0127601 | A1 * | 6/2008 | Schiffmann et al. | 52/741.1 |

FOREIGN PATENT DOCUMENTS

| | | | |
|---|---|---|---|
| KR | 10-2007-0122190 | A | 12/2007 |
| KR | 10-2010-0059051 | A | 6/2010 |

OTHER PUBLICATIONS

International Search Report and Written Opinion completed Aug. 14, 2012; issued in International Patent Application No. PCT/US2012/021352.

* cited by examiner

*Primary Examiner* — Stephen Crow
(74) *Attorney, Agent, or Firm* — Henry B. Ward, III; Moore & Van Allen PLLC

(57) ABSTRACT

A form assembly and method is provided for use in making a jump pit having a cover. The form assembly comprises at least one frame member structured to form a ledge for receiving the cover and a removable form member removably secured to the frame member. The method comprises providing a frame member and removably securing a removable form member to the frame member.

11 Claims, 11 Drawing Sheets

FORM ASSEMBLY FOR A JUMP PIT

BACKGROUND

Long jump/triple jump pits ("jump pits") have been known and used in track and field for some time. The jump pit itself is typically a rectangular sand pit with a runway leading up to one of the short sides of the rectangle. The jump pit must hold sufficient quantities of sand to cushion an athlete's landing following a jump. The sand in the jump pit must be protected from ambient and environmental conditions and contingencies, such as weather elements and animals. The sand must be kept dry and clean to preserve its integrity and to protect the athletes, and it must be free of debris. Therefore, it is preferable to provide a jump pit with a perimeter containment wall that includes reasonably well-fitting cover that minimizes gaps where the cover contacts the containment wall of the jump pit. Such covers can be made of a variety of materials, including wood, fabric (such as a vinyl-coated mesh fabric) or metal, such as aluminum sheeting or panels.

There are a number of steps involved in building a custom form assembly for creating a jump pit, and there are many difficulties to overcome before achieving the end result of a sand pit of predetermined size that will receive a standard cover without gaps where the cover contacts the periphery of the jump pit. Most jump pits are created by digging a recess in the ground having dimensions slightly larger than the desired dimension of the jump pit, building a form assembly about the perimeter of the recess that is dimensioned so as to provide a perimeter containment wall in which the interior dimensions of the wall correspond to the desired exterior dimensions of the jump pit. The containment wall is typically formed of a moldable forming composition, such as a cementitious material (e.g., concrete), a polymer concrete or a similar material. The form will typically comprise interior and exterior frame members that are secured in place a predetermined distance apart from one another and that are structured to laterally contain the moldable forming composition used to form the wall while the moldable forming composition cures. The interior and exterior form members are commonly formed of wood. Rebar or other similar internal structural elements may be positioned between the interior and exterior form members to increase the structural strength of the wall. The interior and exterior form members may also be coupled together using metal wire or mechanical fasteners to prevent movement of one form member away from the other form member.

It is common to form a ledge along the upper, interior corner of the wall that is dimensioned to receive the cover. In one embodiment, the depth of the ledge corresponds approximately to the thickness of the cover and two (2) times the width of the ledge plus the width of the jump pit corresponds approximately to the width of the cover. The ledge is sometimes formed using an L-shaped channel, which, in one embodiment, is formed of aluminum.

One difficulty often encountered when building the form is positioning and securing each of the components correctly in place and maintaining such positioning when pouring the moldable forming composition into the form. As such, onsite forms result in jump pits of varying dimensions, due to slight variations in sizes of custom-built components, shifting of form assembly components during the pouring and curing of the moldable forming composition. In particular, it can be difficult to form the ledge so that the ledge is level around the entire perimeter. This difficulty arises in part due to problems associated with positioning and securing the L-shaped channel correctly in place and maintaining such positioning as the moldable forming composition is poured into the form, as the moldable forming composition has a tendency to urge the channel upwards and laterally away from the form. These variations, among other things, can result in a jump pit of uneven dimensions that requires fitting with a custom cover.

A further challenge to creating a jump pit using a custom built onsite assembly form is the difficulty in removing the form components after the moldable forming composition is poured and cured. This can be a labor intensive, time consuming process that can result in components being broken in order to dislodge them from the containment wall formed by the moldable forming composition.

BRIEF SUMMARY OF THE INVENTION

Embodiments of the invention are directed to form assembly for a jump pit and a method of making a jump pit. In one embodiment, there is provided a form assembly for use in making a jump pit having a cover. The form assembly comprises at least one frame member structured to form a ledge for receiving the cover; and a removable form member removably secured to the frame member. In another embodiment, the form assembly further comprises a first form member removably attached to the removable form member.

In one embodiment, a method for making a jump pit is provided comprising providing a frame member; and removably securing a removable form member to the frame member. In one embodiment, the method comprises attaching a first form member to the removable form member.

BRIEF DESCRIPTION OF THE DRAWINGS

Reference will now be made the accompanying drawings, wherein.

Regarding the drawings, like reference numbers refer to like structures throughout. It should be noted that the drawings are schematic in nature. Not all parts are always shown to scale. The drawings and photographs illustrate but a few specific embodiments of the invention.

DETAILED DESCRIPTION OF EMBODIMENTS OF THE INVENTION

Embodiments of the present invention will now be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. Where possible, any terms expressed in the singular form herein are meant to also include the plural form and vice versa, unless explicitly stated otherwise. Also, as used herein, the term "a" and/or "an" shall mean "one or more," even though the phrase "one or more" is also used herein. Furthermore, when it is said herein that something is "based on" something else, it may be based on one or more other things as well. In other words, unless expressly indicated otherwise, as used herein "based on" means "based at least in part on" or "based at least partially on." Like numbers refer to like elements throughout.

Embodiments of the present invention provide a form assembly 10 for making a jump pit, the form assembly comprising at least one frame for receiving a cover in the finished pit and a first form member removably secured to the frame. In some embodiments, the form further comprises a second form member removably secured to the first form member.

Figure 1B:
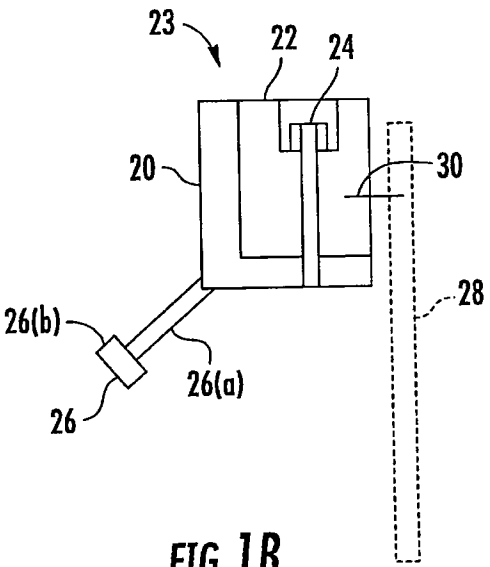
FIG. 1B is a cross-sectional view along lines A-A in FIG. 1A illustrating the partial form assembly.
Figure 1A:
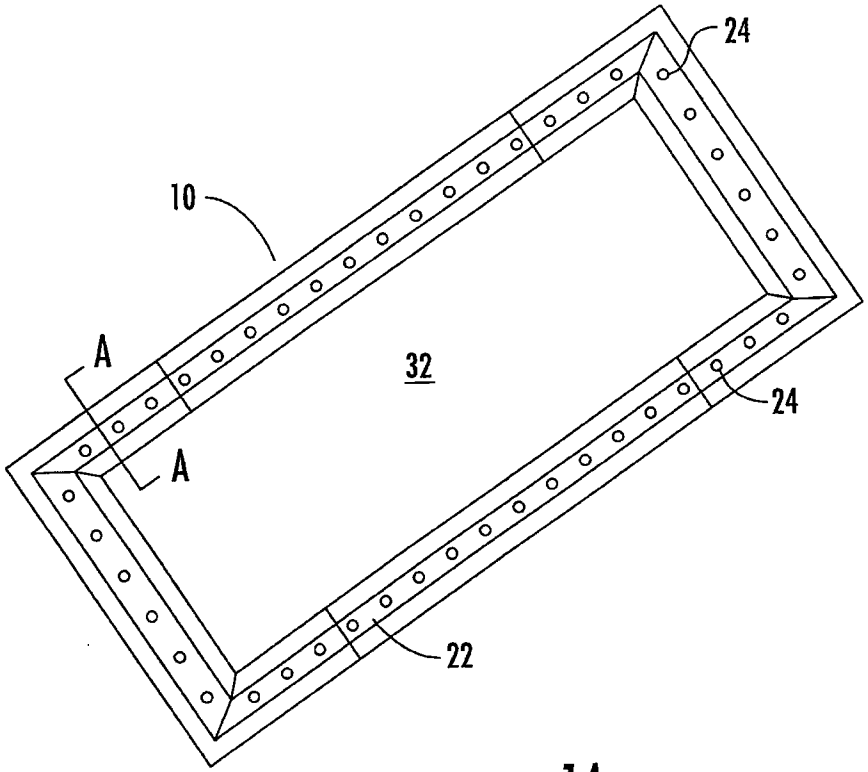
FIG. 1A is a top view illustrating a partial form assembly for forming a jump pit of predetermined configuration using a moldable forming composition, according to one embodiment of the present invention.
Figure 2:
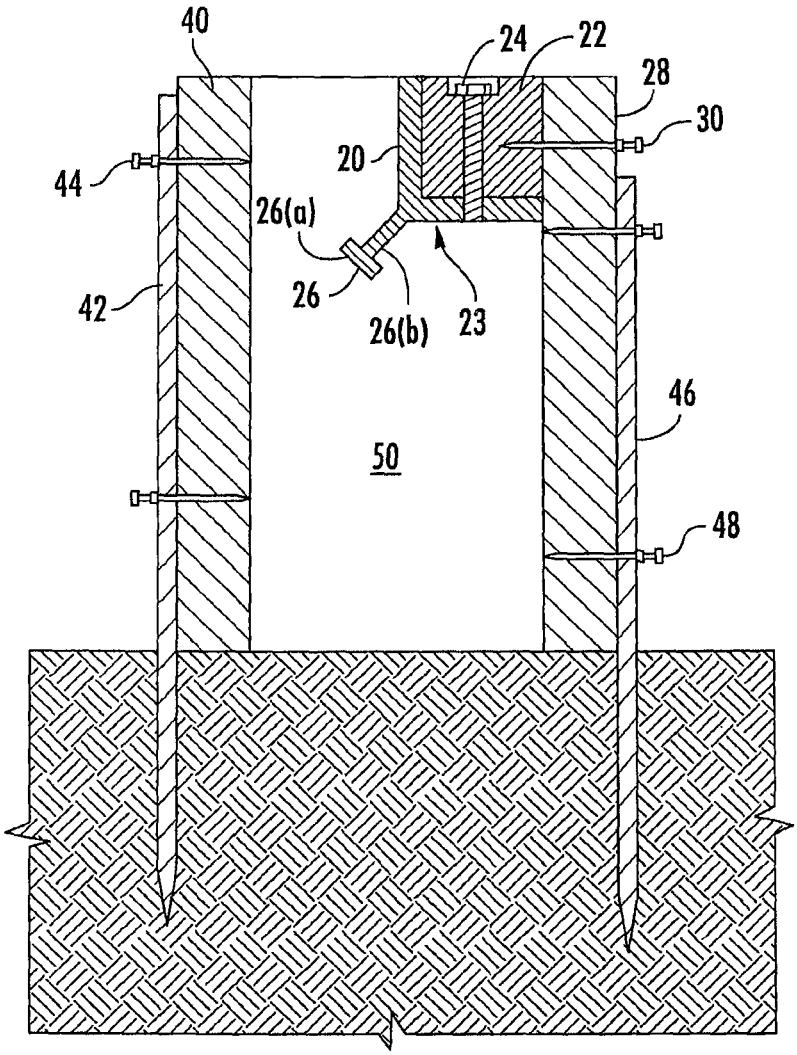
FIG. 2 is a cross-sectional view illustrating a completed version of the form assembly illustrated in FIG. 1A, according to one embodiment of the present invention.

Referring to the drawings and, in particular to FIG. 2, there is illustrated a form assembly 10 for making a jump pit 32, according to one embodiment of the present invention. As illustrated in FIG. 2, the form assembly 10 comprises a ledge forming component 23 and a first form member 28 and second form member 40. As can be seen in FIG. 1A, the overall configuration of the jump pit form assembly 10 forms a rectangle. As illustrated in FIG. 2, the exterior perimeter of the rectangle is formed by and comprises the second form member 40. The first form member 28 and second form member 40 can be formed of a variety materials, including wood, metal, plastic, etc., provided the materials have sufficient rigidity to contain the moldable forming composition when poured.

Figure 11:
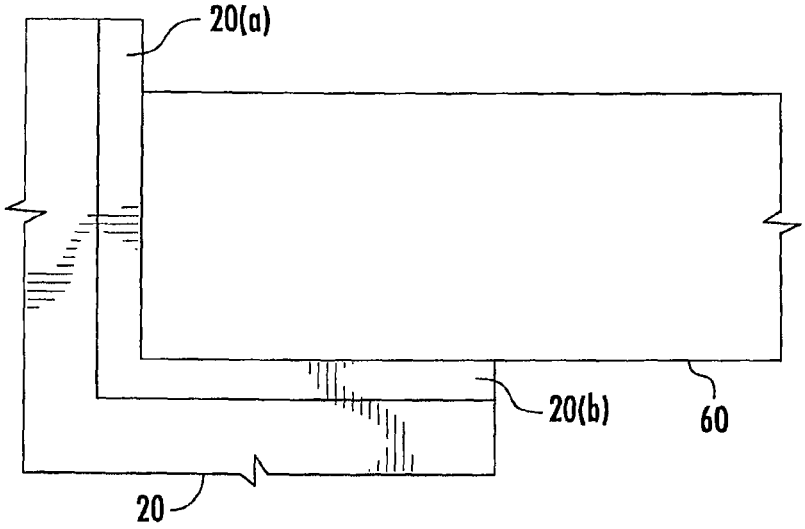
FIG. 11 is a partial cross-sectional view of the perimeter containment wall of the completed jump pit with an L-shaped channel being positioned along the ledge, and wherein the ledge is holding a cover, according to one embodiment of the present invention.

In at least some embodiments, the frame member 20 has an "L"-shaped configuration. In one embodiment, the frame member 20 is made of metal. In one embodiment, the metal frame member 20 is made of aluminum. However, one of ordinary skill in the art understands that other materials may be used that would still fall within the scope of the present invention. As illustrated in FIGS. 1B and 2, the ledge forming component 23 further comprises a removable form member 22 removably attached to the frame member 20 via one or more removable connectors 24 structured to extend through an aperture in the removable form member and to matingly engage an aperture in the second side 20(*b*) of the frame member. In one embodiment, the removable connector 24 comprises a threaded screw that is structured to threadably engage a threaded aperture in the second side 20(*b*) of the frame member 20. The frame member 20 may be made of a variety of materials, including, without limitation, metal, wood or plastic. The frame member 20 is structured and dimensioned to receive a removable form member 22. In one embodiment, as illustrated in FIG. 11, the depth of the frame member 20 (i.e., the length of the first side 20(*a*) of the frame member) corresponds approximately to the thickness of the cover 60 and two (2) times the width of the frame member 20 (i.e., the length of the second side 20(*b*) of the frame member) plus the width of the jump pit corresponds approximately to the width of the cover.

The removable form member 22 may fill the area formed by the frame member 20, as illustrated in FIGS. 1B and 2, or alternatively, the removable form member may fill only a portion of the area formed by the frame member. The removable form member 22 may be made of a variety of materials, including, without limitation, metal, wood or plastic. The removable form member 22 is preferably made of a material having a density and hardness such that a mechanical fastener (e.g., a nail or screw) can be inserted and held in place. In one embodiment, the removable form member 22 is made of wood. The second side 20(*b*) of the frame member 20 forms a "ledge" when the removable form member 22 is detached from the frame member. The ledge supports the cover for the finished jump pit.

The removable form member 22 is removably secured or attached to the frame member 20. As discussed above and illustrated in FIGS. 1B and 2, the removable form member 22 may be removably secured or attached to the frame member 20 using one or more removable connectors 24. The removable connectors 24 can comprise any mechanical fastener that can be used to secure or attach the removable form member 22 to the frame member 20 and then can be removed or released so that the removable form member 22 can be detached from the frame member. Examples of suitable mechanical fasteners include, but are not limited to, nails, screws, bolts and staples. In some embodiments, the removable form member 22 is removably secured to the frame member 20 by at least one removable connector 24, as can be seen in FIGS. 1A and 1B. The removable connector 24 will be placed at pre-determined or random intervals along the removable form member 22, as can be seen in FIG. 1A, so that the removable form member is securely held during the pouring and curing of the moldable forming composition that will form the perimeter containment wall of the jump pit.

In one embodiment, as illustrated in FIGS. 1B and 2, the frame member 20 comprises one or more studs 26 extending therefrom. In one embodiment, the studs 26 have a shaft 26(*b*) and a head 26(*a*) and are structured to be encased within the moldable forming composition once it has cured to thereby anchor the frame member 20 to the perimeter containment wall of the jump pit. Each stud 26 can be formed integrally with the frame member 22, can be attached to the frame member by welding or using an adhesive, or can comprise a threaded portion that threadably engages a threaded aperture in the frame member.

Figure 3:
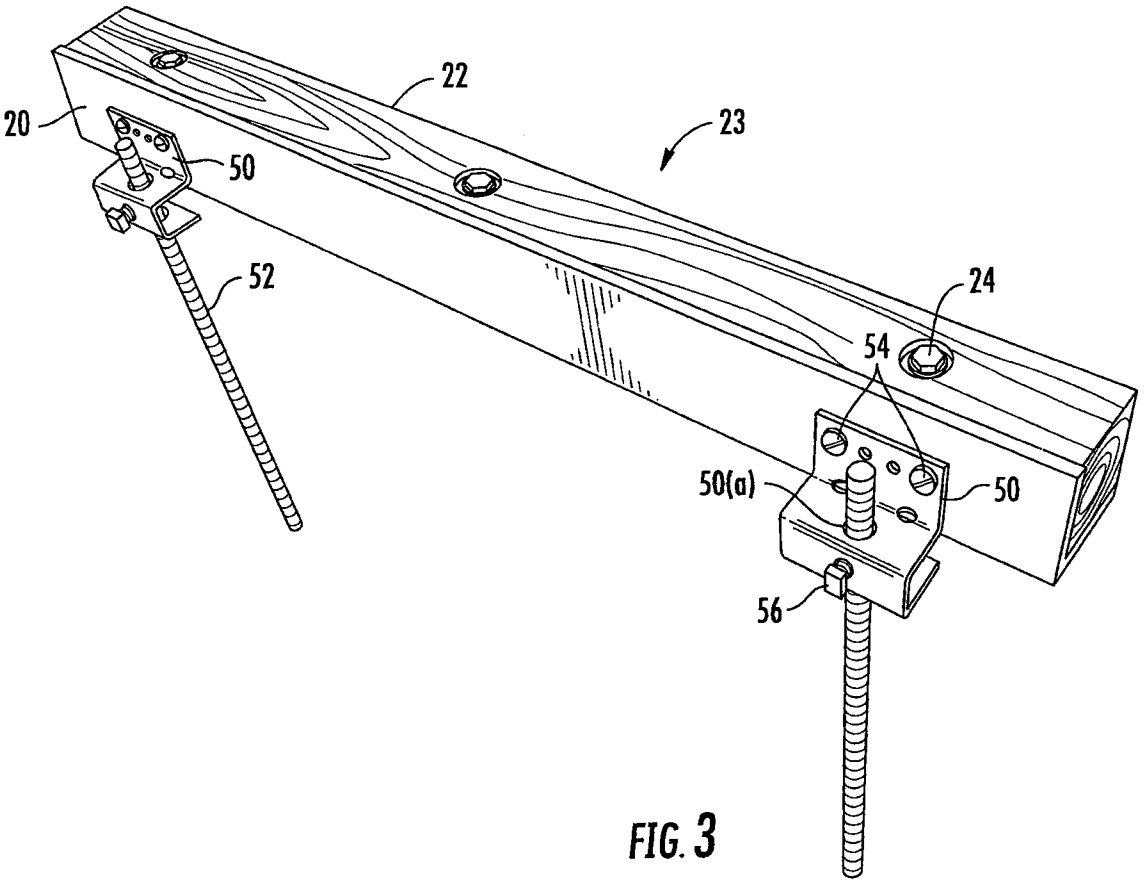
FIG. 3 is a photograph illustrating a top perspective view of the ledge forming component of a form for forming a jump pit of predetermined configuration using a moldable forming composition, according to one embodiment of the present invention.
Figure 4:
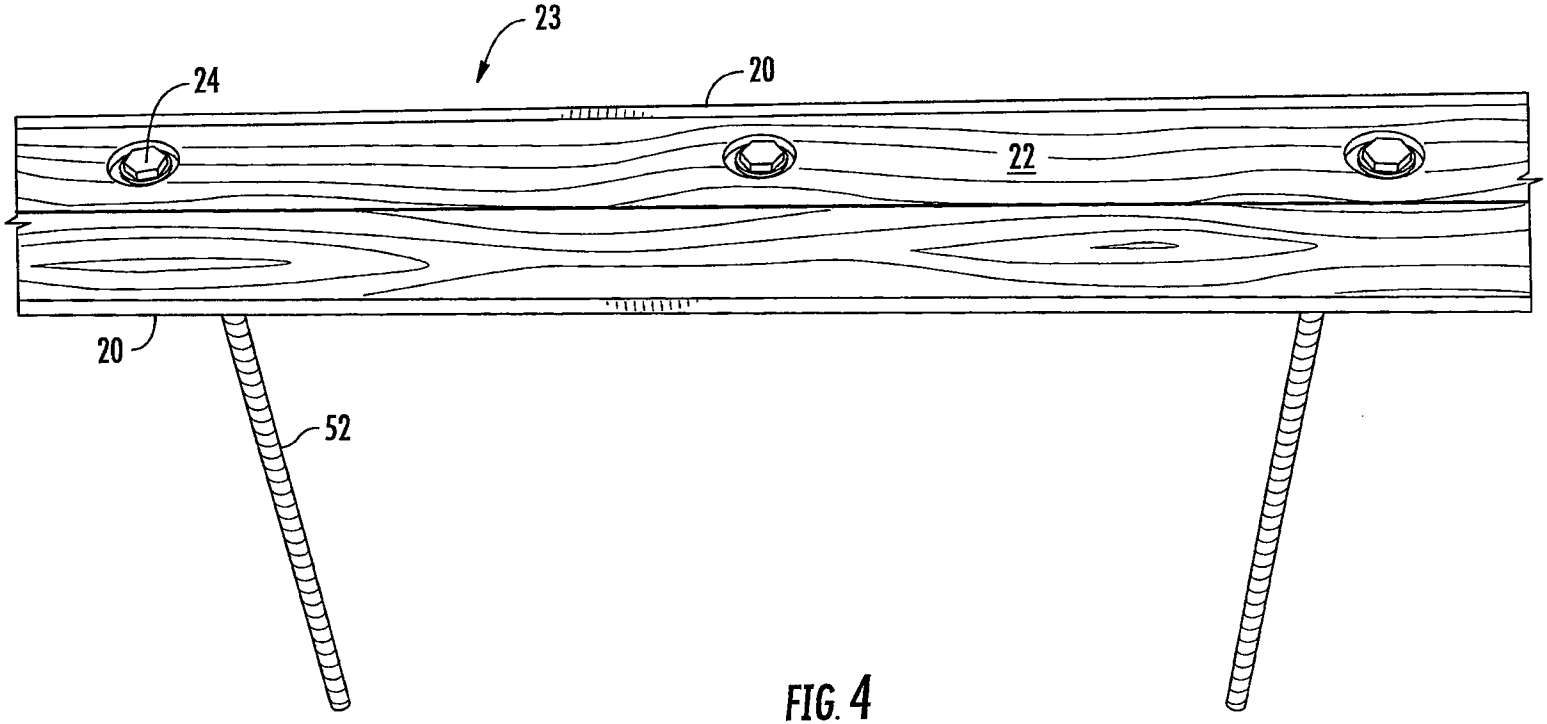
FIG. 4 is a photograph illustrating a top perspective view of the ledge forming component of FIG. 3.
Figure 5:
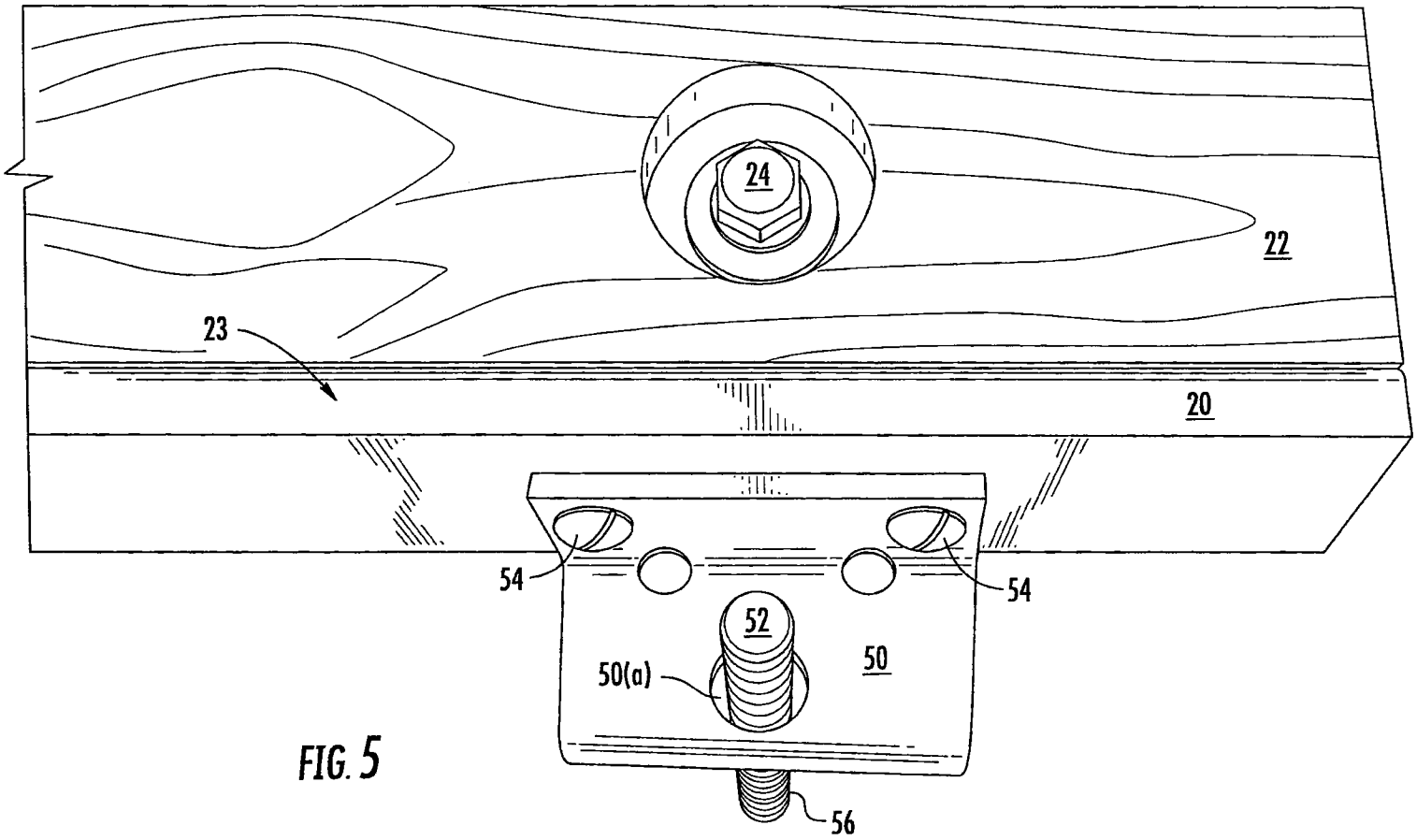
FIG. 5 is a photograph illustrating a top view of one removable connector of the ledge forming component of FIG. 3.
Figure 6:
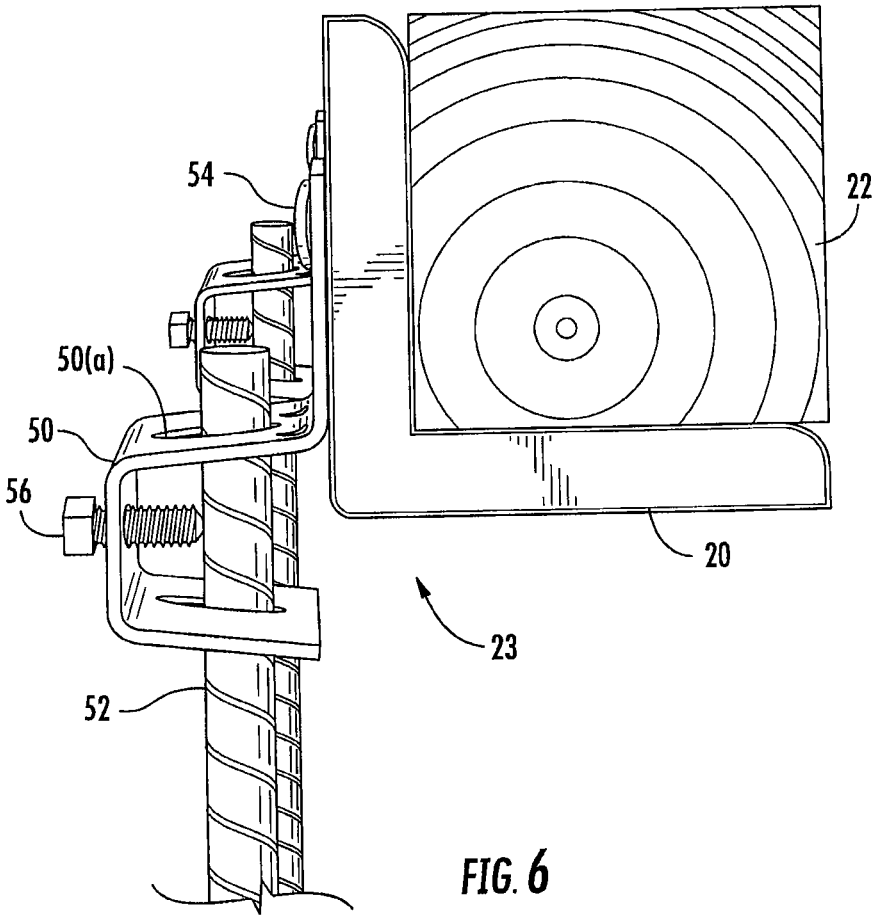
FIG. 6 is a photograph illustrating an end view of the ledge forming component of FIG. 3.
Figure 7:
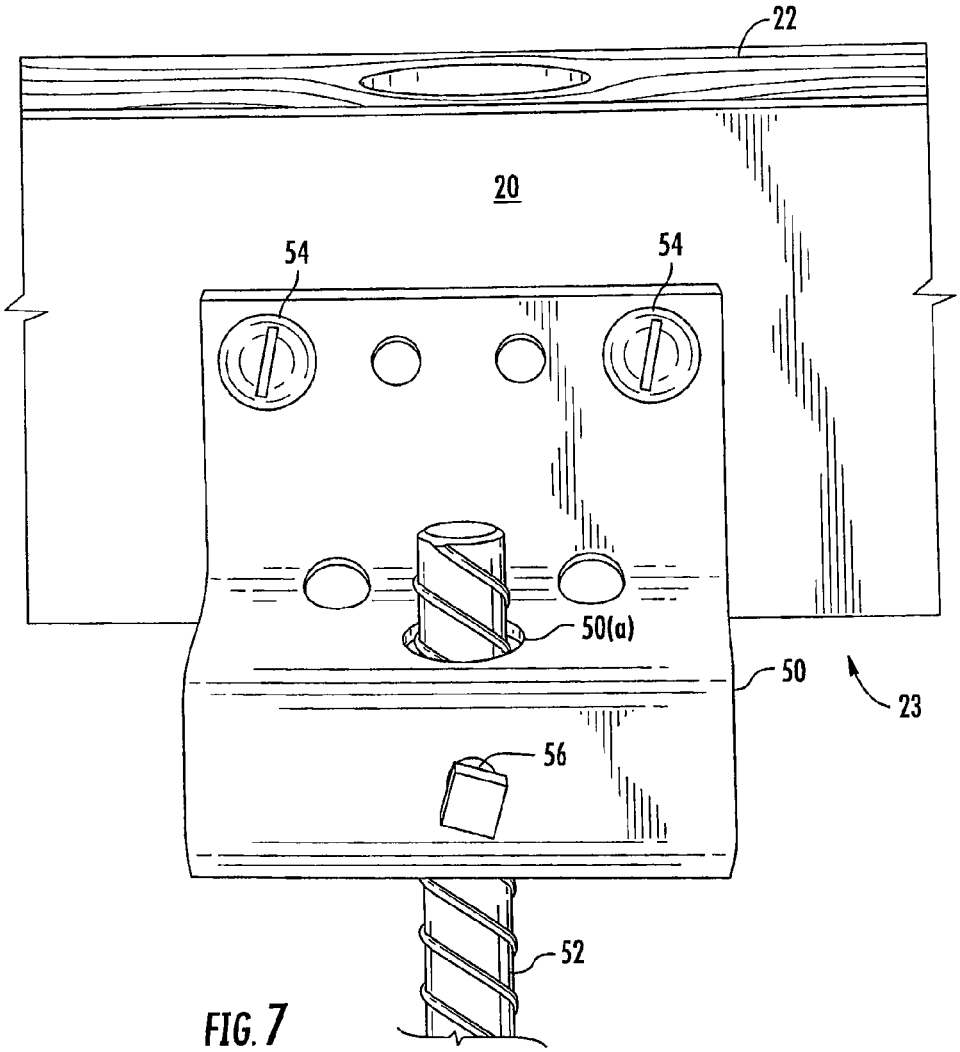
FIG. 7 is a photograph illustrating a side view of the ledge forming component of FIG. 3.

In another embodiment, as illustrated in FIGS. 3-10, the frame member 20 comprises one or more brackets 50. Each bracket 50 can be formed integrally with the frame member 22, can be attached to the frame member by welding or using an adhesive, or can be attached to the frame member using a mechanical fastener (e.g., screws, bolts, nails, etc.). For example, in one embodiment, as illustrated in FIGS. 5 and 7, the bracket 50 is attached to the frame member 22 via threaded screws 54 structured to be threadably engaged by threaded apertures in the frame member. In one embodiment, as illustrated in FIGS. 5 and 7, the bracket 50 defines an aperture 50(*a*) structured to receive a reinforcement member 52 (e.g., rebar). The reinforcement member 52 can be secured to the bracket 50 by welding or using an adhesive or can be attached to the bracket using a mechanical fastener. For example, in one embodiment, as illustrated in FIGS. 5-10, a threaded set screw 56 is structured to be threadably received within a threaded aperture in the bracket and to contact the reinforcement member 52 and urge it against the sidewall of the aperture 50(*a*).

Referring to FIGS. 1B, 2 and 9-10, in one embodiment of the present invention, a first form member 28 is removably secured to the removable form member 22. The first form member 28 can be removably secured to the removable form member 22 using any mechanical fastener that can be used to secure or attach the first form member 28 to the removable form member 22 and then can be removed or released so that the first form member 28 can be detached from the removable form member 22. Examples of suitable mechanical fasteners include, but are not limited to, nails, screws, bolts and staples. In one embodiment, the first form member 28 is removably secured to the removable form member 22 by at least one nail 30, as illustrated in FIG. 1B.

Referring to FIG. 2, there is illustrated a cross-section of an embodiment of the completed forming assembly 10, which includes the ledge forming component 23, and the first form member 28 and second form member 40. In one embodiment, the first form member 28 is secured to a stake 46 that is anchored into the ground. The first form member 28 can be secured to the stake 46 using any mechanical fastener 48, which may include, but is not limited to, nails, screws, bolts and staples. Alternatively, the first form member 28 can be secured to the stake 46 using an adhesive, by welding, or by forming the two integrally together. According to one embodiment, as illustrated in FIG. 2, in one embodiment, the first form member 28 is removably secured to the stake 46 by at least one nail 48. In the alternate embodiment of the ledge forming component 23 illustrated in FIGS. 3-10, the first form member 28 may be further supported by (or solely supported by) the reinforcement member 52 attached to the ledge forming component 23, as discussed above.

In one embodiment, the second form member 40 is secured to a stake 42 that is anchored into the ground. The second form member 40 can be secured to the stake 42 using any mechanical fastener 44, which may include, but is not limited to, nails, screws, bolts and staples. Alternatively, the second form member 40 can be secured to the stake 42 using an adhesive, by welding, or by forming the two integrally together. According to one embodiment, as illustrated in FIG. 2, in one embodiment, the second form member 40 is secured to the stake 42 by at least one nail 44.

Referring to FIG. 2, it can be seen that the area 50 formed between the first form member 28 and the second form member 40 is the cavity or trench into which the moldable forming composition is poured. Thus, the area 50 becomes the perimeter containment wall of the jump pit after the moldable forming composition is poured and cured, and the form materials are removed.

The frame member 20 forms the top, interior perimeter of the perimeter containment wall of the jump pit. The interior of the jump pit 32 will be empty during the assembly of the jump pit form assembly and the pouring of the moldable forming composition to form the perimeter containment wall. After the moldable forming composition is poured and cured, the form assembly 10 is removed from the perimeter containment wall with the exception of the frame member 22 (and in the case of the embodiments illustrated in FIGS. 3-10, the reinforcement member(s) 52). In this regard, the second form member 40 is removed from the exterior side of the containment wall by removing the stake(s) 42 from the ground and then moving the second form member away from the perimeter containment wall. The first form member 28 is removed from the interior side of the containment wall by removing the removable connector(s) 24 from the frame member 22, then removing the stake(s) 46 from the ground, then moving the first form member and the removable form member away from the perimeter containment. Once the form assembly 10 has been removed, as discussed above, the interior of the jump pit 32 can be filled with sand.

The form assembly 10 for making a jump pit provided herein creates a jump pit having a perimeter containment wall with a ledge at its top, interior perimeter, the ledge formed by the frame member 20. Once the jump pit has been completed and filled with sand, the ledge formed by the frame member 20 serves to accept a cover 60 for the jump pit, as illustrated in FIG. 11. Advantageously, because the form assembly 10 enables the frame member 20 to be efficiently incorporated into the frame assembly and consistently set in a level position, it is possible to utilize standard, mass-manufactured covers and to have the covers to be well-fitted upon the ledge.

FIGS. 3-8 depict various views of sections of an exemplary embodiment of the invention. Referring to FIG. 3, a section of an exemplary embodiment of the invention is shown. Specifically, a section of a form assembly 10, namely, the ledge forming component 23, is shown which includes a portion of the frame member 20, the removable form member 22, and the removable connector 24 for removably securing the removable form member 22 to the frame member 20. The embodiment shown in FIG. 3 does not include the stud 26, as shown in FIG. 1B and FIG. 2, but rather shows support for the frame member comprising a bracket 50 and reinforcement member 52.

FIG. 4 depicts another view of the same portion of the exemplary embodiment shown in FIG. 3. As in FIG. 3, the frame member 20, the removable form member 22, the removable connector 24, and the reinforcement member 52 are visible in FIG. 4. The bracket 50 is not visible due to the position of the ledge forming component 23 in FIG. 4.

FIG. 5 depicts a top view of a portion of the exemplary embodiment of the ledge forming component 23, as shown in FIG. 3. In FIG. 5, the top of the frame member 20 can be seen, as can the top of the removable form member 22 and the removable connector 24. Also visible are the bracket 50 and the reinforcement member 52 supporting the frame member 20.

FIG. 6 depicts an end view of the exemplary embodiment of the ledge forming component 23, as shown in FIG. 3. Visible in FIG. 6 are the frame member 20, the removable form member 22, the bracket 50 and the reinforcement member 52.

FIG. 7 depicts a close-up view of the exemplary embodiment of the ledge forming component 23, as shown in FIG. 3, focusing on the bracket 50 and the reinforcement member 52. As can be seen in FIG. 7, the bracket 50 is held securely to the frame member 20 by two threaded screws 54, while the reinforcement member 52 is held in place with respect to the bracket 50 by a set screw 56.

Figure 8:
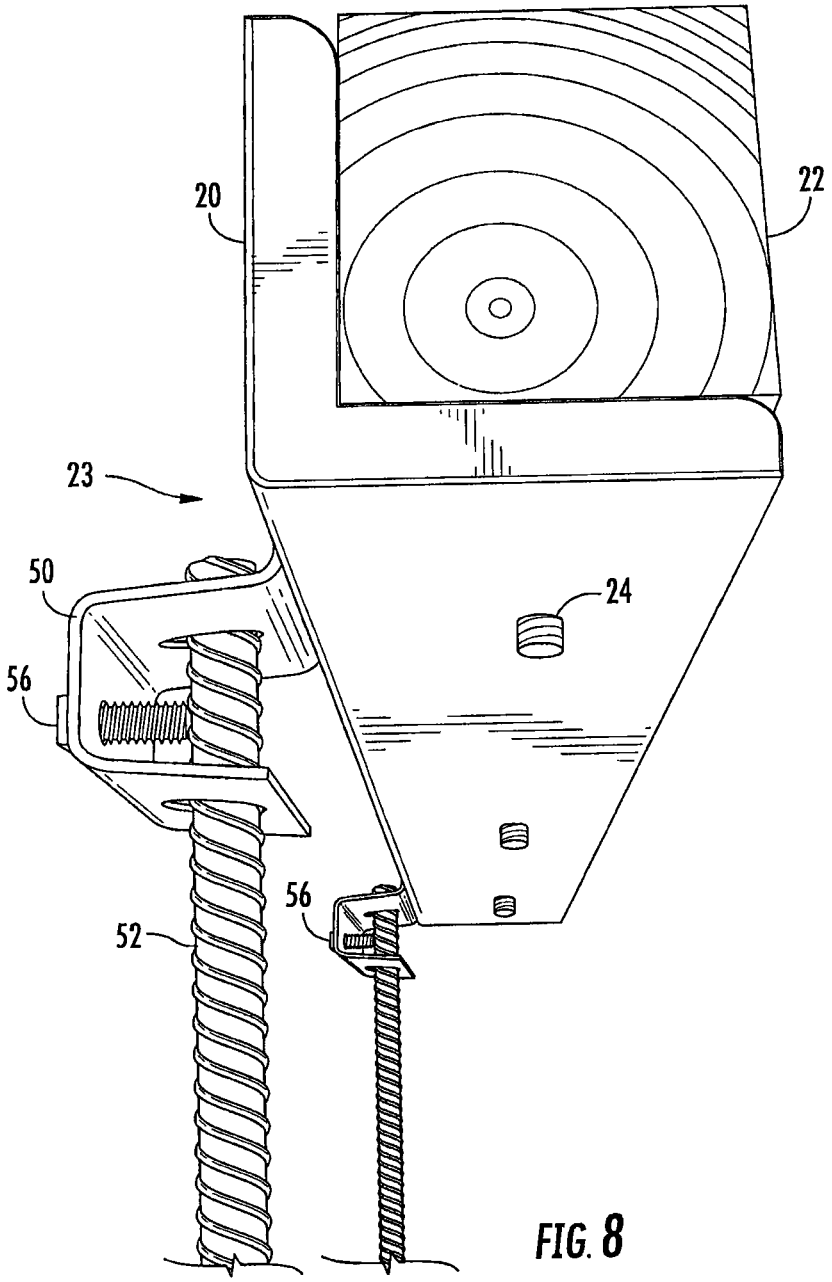
FIG. 8 is a photograph illustrating a perspective-end view of the ledge forming component of FIG. 3.

FIG. 8 shows a perspective-end view of the exemplary embodiment of the ledge forming component 23, as shown in FIG. 3, with the view from below the frame member 20. Visible in FIG. 8 are the frame member 20, the removable form member 22, the bracket 50, the reinforcement member 52, and the set screw 56. Also visible in FIG. 8 are the removable connectors 24 that removably secure the removable form member 22 to the frame member 20.

Figure 9:
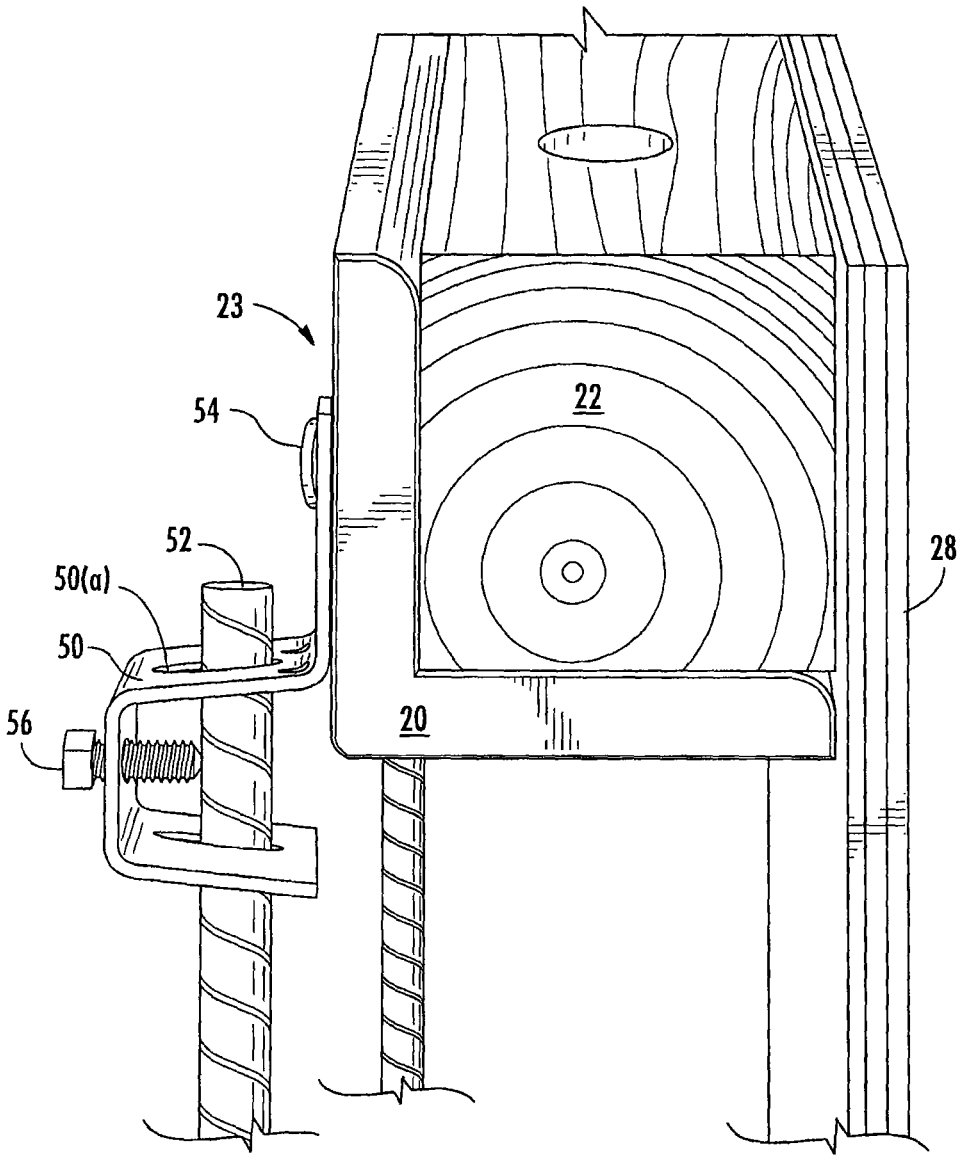
FIG. 9 is a photograph illustrating a perspective-end view of the ledge forming component of FIG. 3 with a first form member attached.
Figure 10:
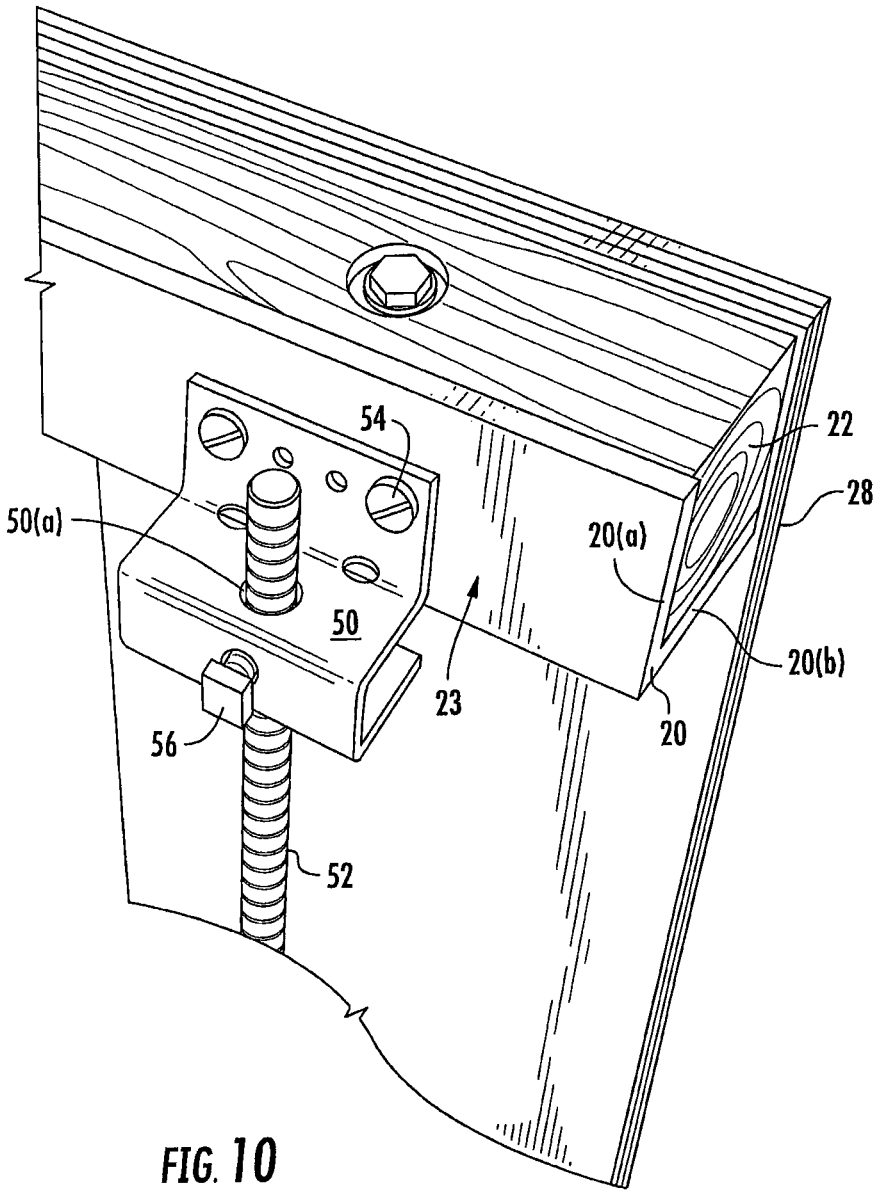
FIG. 10 is a photograph illustrating a perspective-end view of the ledge forming component of FIG. 9 with the first form member attached.

FIGS. 9 and 10 show an exemplary embodiment of the invention with the ledge forming component 23 and a first form member 28. FIG. 9 shows an end view with both the removable form member 22 and the first form member 28 visible according to one embodiment of the invention. In the exemplary embodiment shown in FIG. 9, the removable form member 22 and the first form member 28 are made of wood. One of ordinary skill in the art understands that the removable form member 22 and the first form member 28 may be made of other materials and still fall within the scope of the invention. Also visible in FIG. 9 are the frame member 20, the bracket 50, the reinforcement member 52, and the set screw 56.

FIG. 10 shows an end view of an exemplary embodiment of the invention from an angle. Visible in FIG. 10 are the frame member 20, the removable form member 22, the first form member 28, the bracket 50, the reinforcement member 52, and the screws 54 and set screw 56.

As can be understood from at least FIGS. 2, 9 and 10, pouring a moldable forming composition into the form of the present invention results in a sand pit which has a perimeter containment wall with a ledge for receiving a cover for the jump pit. In one embodiment, the frame member 20 has a first side 20(*a*) and a second side 20(*b*) as noted in FIG. 10. The second side 20(*b*) is the surface which forms the ledge on which a cover 60 can rest or be received. As noted above, the frame member 20 is made of a material with a hard surface that can withstand the pressure of the moldable forming composition that will form the perimeter containment wall of the jump pit. In one embodiment, the frame member 20 is made of metal. In one embodiment, the frame member 20 is made of aluminum.

The second side 20(*b*) of the frame member 20 therefore forms a relatively flat, level surface on which a standard cover 60 may be received. This is an improvement over previous jump pits for which covers had to be custom made in certain instances due to the variations in size and surface area of each jump pit resulting from each individually-created form. Embodiments of the present invention create a jump pit with a perimeter containment wall for receiving a cover so that a standard cover may be designed, manufactured and provided for all jump pits made according to the present invention.

FIG. 11 depicts an exemplary embodiment of the jump pit of the invention in which a ledge has been formed by the frame member 20 and a cover 60 is received onto the ledge 20(*b*) for covering the jump pit. As is shown in FIG. 11, the cover extends beyond the ledge 20(*b*) and out over the jump pit, the area of which is depicted as reference number 32 in FIG. 1A.

Covers for a sand pit formed by embodiments of the present invention can be constructed much as is already known in the art. The cover 60 may be a single unit, or may be comprised of segments of individual planks that can be laid over the jump pit end to end until the entire jump pit is covered. However, it is believed that the ledge for receiving the cover in the present invention, and the form assembly for forming the ledge, are a material improvement over the prior art. The use of the form assembly 10 of the present invention further enables the use of a standardized cover that will cover the sand pit and protect it from the environment, animals and other ambient conditions.

Embodiments of the present invention provide a form assembly and methods for constructing the form assembly and methods of making a jump pit. The ledge forming component 23, and first form member 28, and second form member 40 and other components of the form assembly may be provided in various forms and configurations. In one embodiment, the ledge forming component, and first and second form members are provided in sections to be assembled at the site where the jump pit is to be constructed. In other embodiments, the form assembly (or certain portions thereof, e.g., the ledge forming component 23, the first form member 28 and stake 46 and/or the second form member 40 and the stake 42) can be fully assembled and shipped to the jump-pit site, ready to be installed.

The dimensions of the jump pit will depend upon the applicable athletic rules/regulations to be complied with and may vary due to age and skill level of competitors. Generally speaking, a long jump/triple jump sand pit is a rectangle that is approximately ten (10) feet wide and about twenty-six (26) feet in length. In one embodiment, the jump pit is approximately twenty-six (26) feet long and nine and a half (9.5) feet in width.

In one embodiment, the frame member 20 is approximately three (3) inches high (the first side 20(*a*)) by three (3) inches wide (the second side 20(*b*)) and is approximately one half (½) inch thick. In one embodiment, the removable form member 22 is approximately two and a half (2.5) inches by two and a half (2.5) inches. This provides a ledge that is approximately two and a half (2.5) inches wide on which to place a cover 60, as is depicted in FIG. 11.

Referring to FIG. 2, it can be seen that in one embodiment, the perimeter containment wall of the sand pit is approximately six (6) inches thick.

While certain exemplary embodiments have been described and shown in the accompanying drawings, it is to be understood that such embodiments are merely illustrative of, and not restrictive on, the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations and modifications of the just described embodiments can be configured without departing from the scope and spirit of the invention. Therefore, it is to be understood that, within the scope of the appended claims, the invention may be practiced other than as specifically described herein. In various embodiments described herein may comprise any of the features disclosed herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. Additionally, comparative, quantitative terms such as "less" and "greater", are intended to encompass the concept of equality, thus, "less" can mean not only "less" in the strictest mathematical sense, but also, "less than or equal to."

It should also be pointed out that references may be made throughout this disclosure to figures and descriptions using terms such as "top", "side", "within", "beside", "on", and other terms which imply a relative position of a structure, portion or view. These terms are used merely for convenience and refer only to the relative position of features as shown from the perspective of the reader. An element that is placed or disposed atop another element in the context of this disclosure can be functionally in the same place in an actual product but be beside or below the other element relative to an observer due to the orientation of a device or equipment. Any discussions which use these terms are meant to encompass various possibilities for orientation and placement.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A form assembly for use in making the perimeter containment walls of a jump pit having a cover, the form assembly comprising:

a first form member;

a second form member, the second form member positioned a predetermined distance from the first form member to thereby form a space in between the first and second form members;

at least one ledge forming member, wherein the at least one ledge forming member is positioned adjacent the first form member and at least partially within the space in between the first and second form members, the at least one ledge forming member comprising:

at least one frame member;

at least one bracket, the at least one bracket being secured to the at least one frame member;

at least one reinforcing member, the at least one reinforcing member being secured to the bracket;

at least one removable connector; and a removable form member removably secured to the at least one frame member by the at least one removable connector; and wherein the form assembly is structured to receive a moldable forming composition in the space in between the first and second form members, which moldable forming composition will form the perimeter containment walls of the jump pit upon curing and wherein the first and second form members and the removable form member are structured to be removed from the perimeter containment walls of the jump pit to thereby form a perimeter wall having the at least one frame member secured thereto to form a ledge configured to receive the cover.

2. The form assembly of claim 1 the first form member is removably attached to the removable form member.

3. A method for making the perimeter containment walls of a jump pit having a cover, the method comprising:

providing a first form member;

providing a second form member;

positioning the first and second form members a predetermined distance apart to thereby form a space in between the first and second form members;

providing at least one ledge forming member, the at least one ledge forming member comprising:

at least one frame member;

at least one bracket, the at least one bracket being secured to the at least one frame member;

at least one reinforcing member, the at least one reinforcing member being secured to the bracket;

at least one removable connector; and a removable form member removably secured to the frame member by the at least one removable connector;

positioning the at least one ledge forming member adjacent the first form member and at least partially within the space in between the first and second form members;

pouring a moldable forming composition in the space in between the first and second form members;

curing the moldable forming composition to form the perimeter containment walls of the jump pit; and removing the first and second form members and the removable form member from the perimeter containment walls of the jump pit to thereby form a perimeter wall having the at least one frame member secured thereto to form a ledge configured to receive the cover.

4. The method of claim 3 further comprising attaching first form member to the removable form member.

5. The form assembly of claim 1 wherein the at least one bracket defines an aperture structured to receive the at least one reinforcing member.

6. The form assembly of claim 1 wherein the at least one bracket includes a connector structured to engage the at least one reinforcing member.

7. The form assembly of claim 6 wherein the position of the at least one bracket along the length of the at least one reinforcing member may be adjusted.

8. The method of claim 3 further comprising removably securing the removable form member to the at least one frame member.

9. The method of claim 3 further comprising securing the at least one bracket to the at least one frame member.

10. The method of claim 9 further comprising securing the at least one reinforcing member to the at least one bracket.

11. The method of claim 10 wherein the step of securing the at least one reinforcing member to the bracket comprises sliding the at least one reinforcing member through an aperture in the at least one bracket and engaging a connector on the bracket against the reinforcing member.

* * * * *